US007121087B2

(12) United States Patent
Hotta et al.

(10) Patent No.: US 7,121,087 B2
(45) Date of Patent: Oct. 17, 2006

(54) EXHAUST EMISSION CONTROL DEVICE OF INTERNAL COMBUSTION ENGINE

(75) Inventors: Isamu Hotta, Kanagawa-ken (JP); Toshikazu Shiino, Kanagawa-ken (JP); Akira Tayama, Kanagawa-ken (JP); Hirofumi Tsuchida, Kanagawa-ken (JP)

(73) Assignee: Nissan Motor Co., Ltd., Yokohama (JP)

( * ) Notice: Subject to any disclaimer, the term of this patent is extended or adjusted under 35 U.S.C. 154(b) by 522 days.

(21) Appl. No.: 09/974,878

(22) Filed: Oct. 12, 2001

(65) Prior Publication Data

US 2002/0053201 A1 May 9, 2002

(30) Foreign Application Priority Data

Nov. 6, 2000 (JP) ..... P2000-337073

(51) Int. Cl.
*F01N 3/02* (2006.01)

(52) U.S. Cl. ..... 60/309; 60/289; 60/297; 60/300; 60/320

(58) Field of Classification Search ..... 60/274, 60/276, 289, 297, 300, 309, 311, 320, 284, 60/285, 299; 422/169–171, 177, 178, 211, 422/217; 55/DIG. 30
See application file for complete search history.

(56) References Cited

U.S. PATENT DOCUMENTS

| | | | | |
|---|---|---|---|---|
| 3,828,552 A | | 8/1974 | Nishiguchi | |
| 5,332,554 A | * | 7/1994 | Yasaki et al. | 60/299 |
| 5,397,550 A | * | 3/1995 | Marino, Jr. | 422/178 |
| 5,447,694 A | * | 9/1995 | Swaroop et al. | 422/171 |
| 5,776,417 A | | 7/1998 | Frost et al. | 422/171 |
| 5,939,028 A | * | 8/1999 | Bennett et al. | 60/297 |
| 6,010,378 A | | 1/2000 | Fujimoto et al. | |
| 6,029,441 A | * | 2/2000 | Mizuno et al. | 60/289 |
| 6,477,831 B1 | * | 11/2002 | Ballinger et al. | 60/299 |

FOREIGN PATENT DOCUMENTS

| | | | |
|---|---|---|---|
| DE | 198 00 654 A1 | | 7/1999 |
| EP | 0 602 963 A1 | | 6/1994 |
| EP | 0 744 054 A | | 5/1997 |
| EP | 0 835 684 A2 | | 4/1998 |
| GB | 2 340 054 A | | 2/2000 |
| JP | 05-231134 A | | 9/1993 |
| JP | 6319948 | * | 11/1994 |
| JP | 409103645 | * | 4/1997 |
| JP | 11-104491 A | | 4/1999 |
| JP | 2000-045756 A | | 2/2000 |
| JP | 2001303939 | * | 10/2001 |
| WO | WO99/34902 A1 | | 7/1999 |

* cited by examiner

*Primary Examiner*—Thomas Denion
*Assistant Examiner*—Diem Tran
(74) *Attorney, Agent, or Firm*—Foley & Lardner LLP

(57) ABSTRACT

In an exhaust path, a HC trapping material which traps HC contained in exhaust gas temporarily, a $H_2O$ trap which traps $H_2O$ contained in exhaust gas and a CO oxidation catalyst are arranged in this order from the upstream side, wherein the $H_2O$ trap is disposed just upstream of and close to the CO oxidation catalyst. $H_2O$ and HC which are components disturbing the activity of the CO oxidation catalyst can be removed efficiently and the adsorption heat and condensation heat of $H_2O$ can be efficiently utilized to raise the temperature of the CO oxidation catalyst so that early activation of the CO oxidation catalyst is accomplished just after an engine starts.

13 Claims, 5 Drawing Sheets

EXHAUST EMISSION CONTROL DEVICE OF INTERNAL COMBUSTION ENGINE

BACKGROUND OF THE INVENTION

1. Field of the Invention

This invention relates to an exhaust emission control device of an internal combustion engine.

2. Description of the Related Art

A three-way catalyst is widely used as the exhaust emission purification catalyst of an internal combustion engine. However, current three-way catalyst has a significantly low efficiency when the temperature is low. For this, various studies are being made to exploit catalysts which are highly active even at low temperatures to thereby decrease emission when the engine starts in low temperature conditions.

U.S. Pat. No. 5,776,417 discloses an exhaust emission control device using a catalyst which is highly active at relatively low temperature.

SUMMARY OF THE INVENTION

The CO oxidation catalyst used in the art described above is improved in activity at low temperatures, however, it is needless to say that it has higher activity at high temperatures. If a rise in temperature is accelerated, the efficiency of engine emission purification just after the engine starts gets improved. In view of this, the inventors of the present invention have made earnest studies concerning unused energy included in exhaust gas which energy is effective to accelerate a rise in temperature.

In the above art, a low temperature light-off CO oxidation catalyst is used. Moreover, a HC trap is arranged upstream of the CO oxidation catalyst and a $H_2O$ trap is further arranged upstream of the HC trap because the low temperature activity of the CO oxidation catalyst is disturbed by the presence of $H_2O$ and HC.

When the $H_2O$ trap adsorbs $H_2O$ contained in the exhaust gas from an engine, heat of adsorption and heat of condensation are emitted. This makes it possible to build up such a hypothesis that a rise in the temperature of the catalyst can be accelerated if these heats are utilized. The inventors have found that these heats are consumed to raise the temperature of the HC trap arranged downstream of the engine and an exhaust pipe and therefore make almost no contribution to a rise in the temperature of the catalyst in the above art.

The inventors carried out experiments on the effect of the heat generated with the trap of $H_2O$. A comparison was made between the case of arranging a HC trap next to a $H_2O$ trap in the same manner as in the above art and the case of arranging a $H_2O$ trap next to a HC trap. As a result, it was confirmed that the temperature of the gas flowing in the CO oxidation catalyst was higher and a rise in the temperature and activation of the oxidation catalyst were more accelerated in the latter case.

The present invention has been made in view of the above experimental results and it is an object of the present invention to attain early activation of a CO oxidation catalyst by removing $H_2O$ which is a component disturbing the activity of the catalyst and by making efficient use of the effect of raising temperature due to the adsorption heat and condensation heat of $H_2O$ when the low temperature light-off CO oxidation catalyst is used.

An exhaust emission control device according to the present invention comprises a CO oxidation catalyst having low temperature light-off characteristics and a $H_2O$ trap arranged adjacent to and upstream of the CO oxidation catalyst.

DETAILED DESCRIPTION OF THE PREFERRED EMBODIMENT

Figure 1:
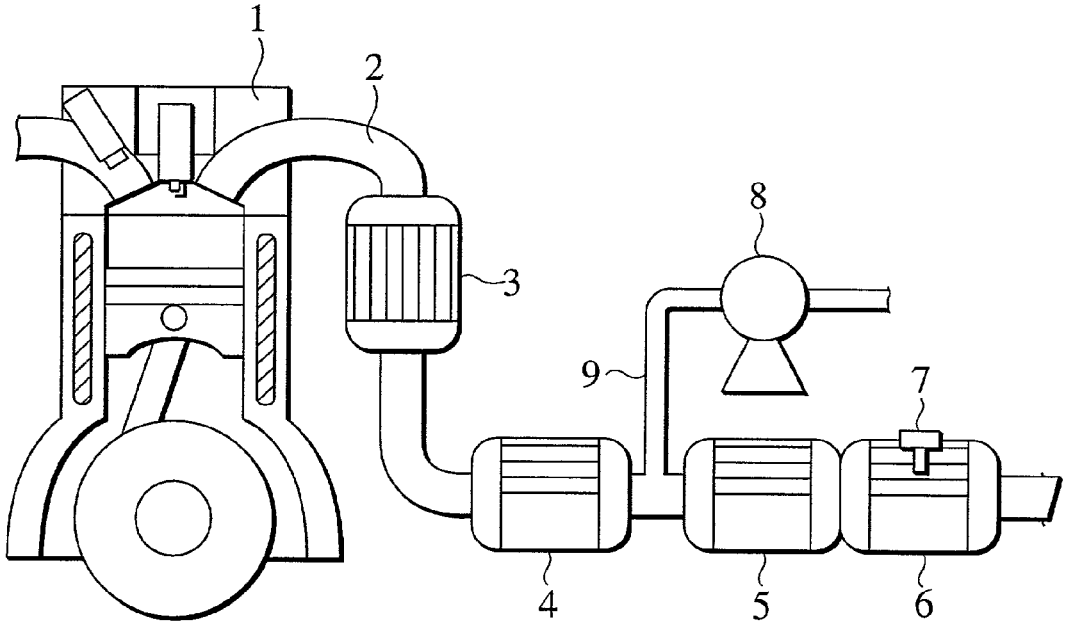
FIG. 1 is a block diagram of an exhaust emission control device of an internal combustion engine according to the first embodiment of the present invention.

A first embodiment of the present invention will be explained with reference to FIG. 1. An exhaust pipe 2 from an engine body 1 is provided with an exhaust emission purification catalyst 3. Further, an underfloor catalyst system containing a CO oxidation catalyst 6 which has low light-off temperature properties is disposed downstream of the exhaust emission purification catalyst 3.

The underfloor catalyst system CS has a structure in which a HC trap 4, a $H_2O$ trap 5 and the CO oxidation catalyst 6 are arranged in this order from the upstream side. Here, the $H_2O$ trap 5 is disposed not only at a position adjacent to and upstream of the CO oxidation catalyst 6 but also close to just the upstream side of the CO oxidation catalyst 6. A temperature sensor 7 is attached to the CO oxidation catalyst 6.

A secondary air introduction pipe 9 extending from an air pump 8 is connected between the HC trap 4 and the $H_2O$ trap 5. Here, the introduced secondary air is used to control a reaction running on the CO oxidation catalyst.

The above exhaust catalyst 3 is a three-way catalyst obtained by coating a honeycomb support with alumina carrying at least one component selected from noble metals such as platinum (Pt), palladium (Pd) and rhodium (Rh) and has the properties that it purifies HC, CO and NOx at the same time when the exhaust air/fuel ratio agrees with the theoretical air/fuel ratio and HC and CO by an oxidation reaction when excessive air is present.

As the above HC trap 4, a material obtained by coating a honeycomb support with a zeolite (for example, b-zeolite, A-type zeolite, Y-type zeolite, X-type zeolite, ZSM-5, USY, mordenite and ferrierite) is used.

As the above $H_2O$ trap 5, a material obtained by coating a honeycomb support with a zeolite (for example, b-zeolite, A-type (3A, 4A, 5A and 13A) zeolite, Y-type zeolite, X-type zeolite, ZSM-5, USY, mordenite and ferrierite) is used. The A-type zeolite (particularly 5A) is particularly preferred.

As the above CO oxidation catalyst 6, a three-way catalyst obtained by coating a honeycomb support with ceria carrying at least one component selected from noble metals such as platinum (Pt), palladium (Pd) and rhodium (Rh). However, any material having the properties (low temperature light-off properties) enabling highly efficient conversion of CO since when the temperature is low may be used. Such catalyst is called "low temperature light-off catalyst", wherein "light-off" means that the catalyst starts a reasonable conversion efficiency.

The above secondary air introduction pipe 9 may be disposed upstream of the CO oxidation catalyst 6 and downstream of the exhaust emission purification catalyst 3. However, if the secondary air introduction pipe 9 is disposed upstream of the HC trap 4, the SB of the HC trap 4 increases to thereby promote the dissociation of HC whereas if it is disposed downstream of the $H_2O$ trap, $H_2O$ which is a component disturbing activity of the catalyst in the secondary air flows into the CO oxidation catalyst 6. Therefore, secondary air introduction pipe 9 is preferably arranged between the HC trap 4 and the $H_2O$ trap 5.

Figure 2:
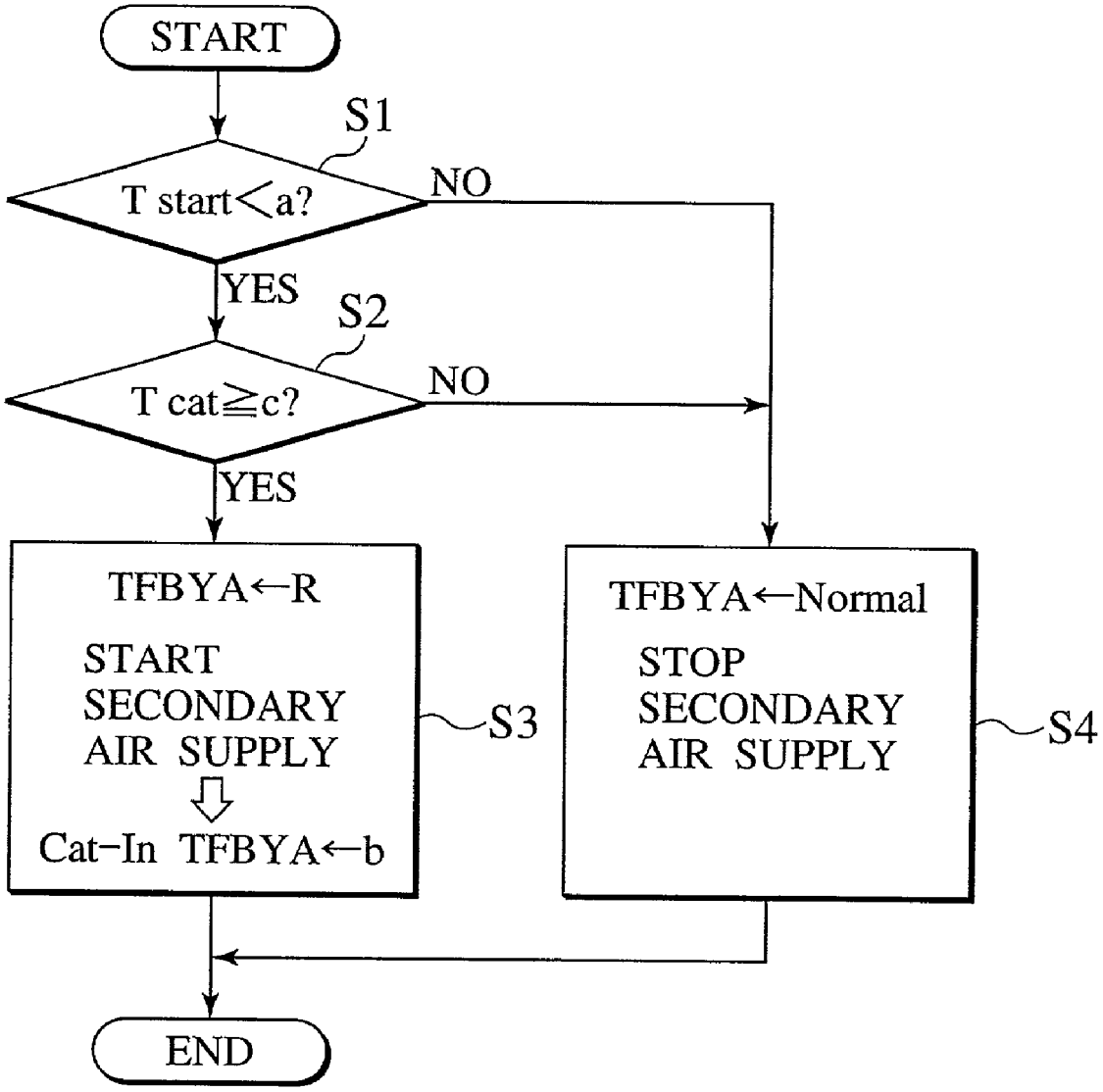
FIG. 2 is a flow chart showing the control of the exhaust emission control device according to the first embodiment.

The control of the operation in this embodiment is carried out according to a flowchart of FIG. 2. This routine is executed, for example, every one second.

In step S1, the start temperature $T_{start}$ of the CO oxidation catalyst which temperature is detected by a CO oxidation catalyst temperature sensor 7 and stored when the engine starts is read to judge whether the temperature $T_{start}$ is less than a predetermined temperature a (for example, 200° C.) or not.

If the temperature $T_{start}$<a, the CO oxidation catalyst 6 is judged to be still inactivated and then the process is forwarded to step S2.

Instep S2, the present temperature $T_{cat}$ of the CO oxidation catalyst 6 which temperature is detected by the CO oxidation catalyst temperature sensor 7 is read to judge whether or not the temperature $T_{cat}$ is made to be above a predetermined temperature c (for example, 600° C.) by treatment in step S3 as will be explained later.

If the temperature $T_{start}$<c, the CO oxidation catalyst 6 is judged to be still inactivated and then the process is forwarded to step S3.

In step S3, in order to introduce a large amount of CO and air into the CO oxidation catalyst 6, a target fuel/air ratio TFBYA under the control of injection quantity is set to a predetermined fuel/air ratio (for example, 1.5) while the air pump 8 is allowed to operate, thereby supplying secondary air to set the ratio (Cat-In TFBYA) of exhaust fuel/air flowed into the CO oxidation catalyst 6 to a predetermined fuel/air ratio b (for example, 0.9) by the control of the secondary air.

Here, the target fuel/air ratio TFBYA is the reciprocal of excess air ratio ? and takes 1 at the theoretical fuel/air ratio, a number more than 1 when excess fuel is present and a number less than 1 when excess air is present. When the target fuel/air ratio TFBYA is set, an injection quantity $T_p$ is set by multiplying the basic injection quantity ($K \cdot Q_a/N_e$; K is constant) corresponding to the theoretical air/fuel ratio and determined by an intake air flow $Q_a$ and an engine speed $N_e$ by the target fuel/air ratio TFBYA. Based on the injection quantity $T_p$, a fuel injection valve on the side of the engine 1 is driven to inject fuel.

Moreover, the amount of secondary air is set by the injection quantity $T_p$, the intake air flow $Q_a$, the predetermined fuel/air ratio R and the predetermined fuel/air ratio b. The predetermined fuel/air ratio R and the predetermined fuel/air ratio b are found in advance by experiments.

Such a treatment in step S3 allows an oxidation reaction to proceed between a large amount of CO and air to promote a rise in the temperature of the CO oxidation catalyst 6 due to reaction heat. If $T_{act}$=c, the CO oxidation catalyst 6 is judged to be in an activated condition based on the judgment in step S2 in the routine on and after the next time and then the process is forwarded to step S4. The predetermined temperature c is found in advance by experiments.

In step S4, the target fuel/air ratio TFBYA is returned to a normal and also the air pump 8 is terminated to stop supplying the secondary air whereby the engine control is returned to normal.

On the other hand, when $T_{start}$=a in the judgment of step S1, the CO oxidation catalyst 6 is judged to be in an activated condition and then the process is forwarded to step S4. In step S4, the target fuel/air ratio TFBYA is set to normal and secondary air is not supplied by the air pump 8 to bring the system under normal engine control. The predetermined temperature a is found in advance by experiments. It is to be noted that the following method may be adopted instep S1. Specifically, the temperature of engine water when the engine starts is detected instead of the temperature of the CO oxidation catalyst when the engine starts and based on this result, the decision is made in the same manner as above.

Figure 3A:
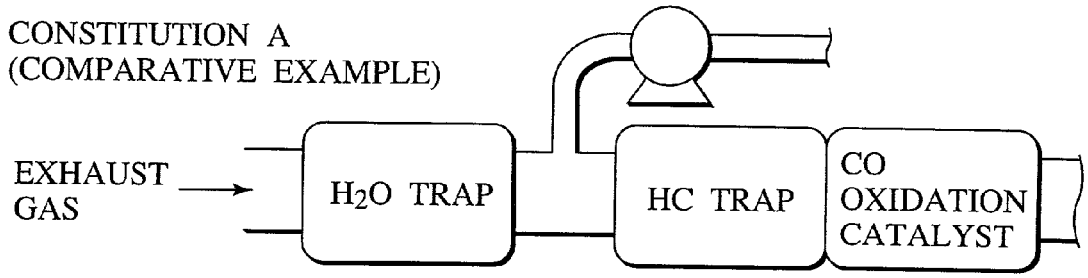
FIG. 3A is a block diagram according to a comparative example wherein a HC trap is arranged downstream of a $H_2O$ trap.
Figure 3B:
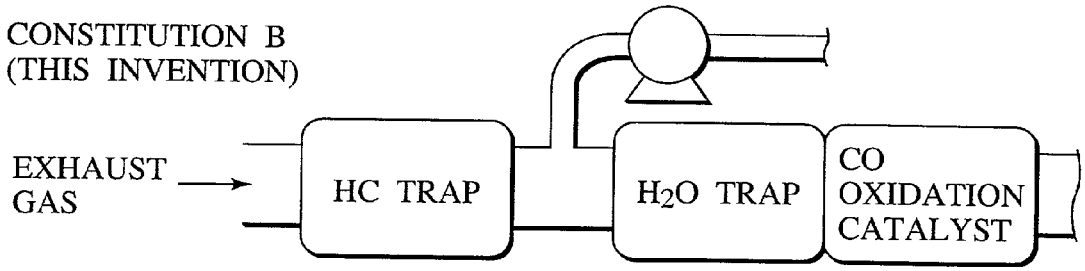
FIG. 3B is a block diagram according to the present invention wherein a $H_2O$ trap is arranged downstream of a HC trap.
Figure 3C:
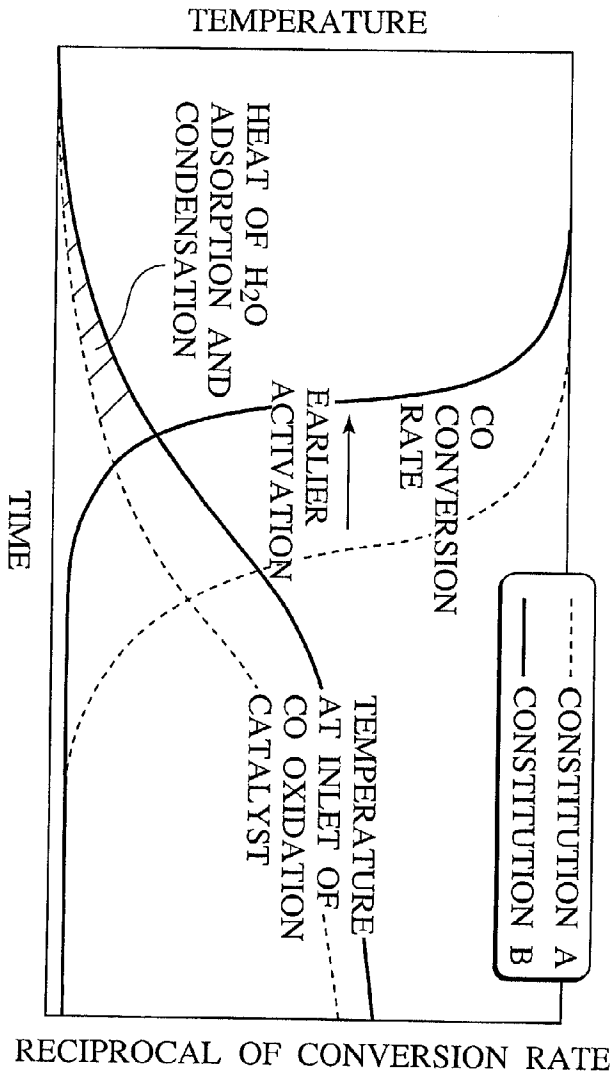
FIG. 3C is a graph showing the relationship between the structures of a catalyst and a trap in an exhaust emission control device and the time of the activation of the catalyst.

FIG. 3C shows the results of experiments for car evaluation when the constitution A (comparative example) and the constitution B (present invention) are used in an underfloor catalyst system shown in FIG. 1.

A rise in the temperature of the inlet for the CO oxidation catalyst when the engine starts at low temperatures is more significant in the case of the constitution B (present invention) in which the HC trap, the $H_2O$ trap and the CO oxidation catalyst are arranged in this order from the upstream side to dispose the $H_2O$ trap just upstream of the CO oxidation catalyst than in the case of the constitution A (comparative example) in which the $H_2O$ trap, the HC trap and the CO oxidation catalyst are arranged in this order from the upstream side. Therefore, the CO oxidation catalyst is early activated in the case of the present invention. This is because the adsorption heat and condensation heat of $H_2O$ in the $H_2O$ trap contribute efficiently to a rise in the exhaust gas temperature. In the case of the constitution A, because these generated heats are consumed for heating of the exhaust pipe and for heat radiation from the exhaust pipe, they do not contribute efficiently to a rise in the exhaust gas temperature.

Next, a second embodiment of the present invention will be explained.

Figure 4:
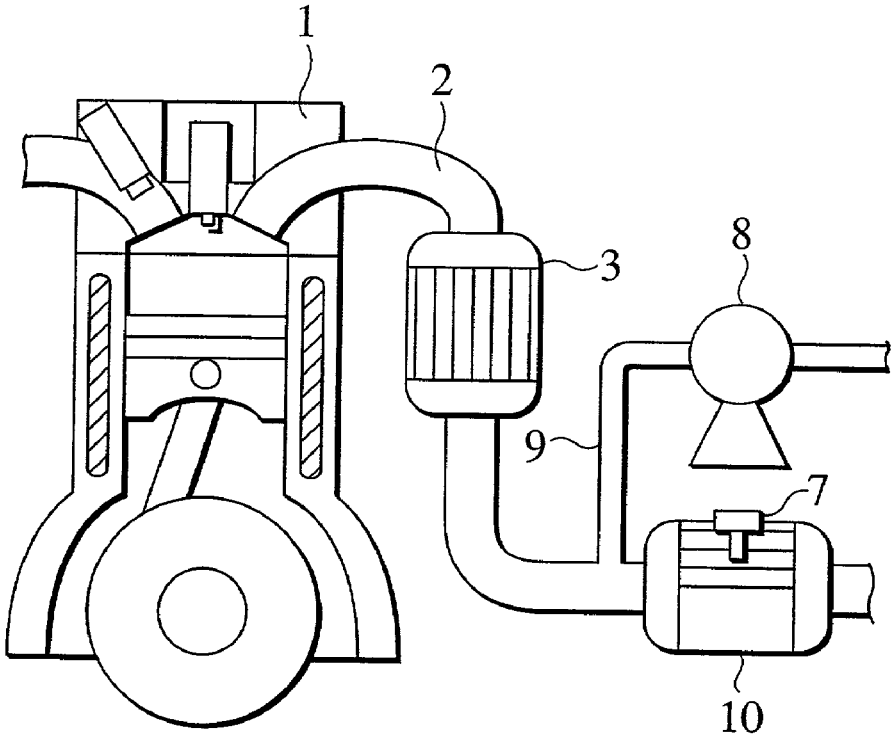
FIG. 4 is a block diagram of an exhaust emission control device of an internal combustion engine according to the second embodiment of the present invention.
Figure 5:
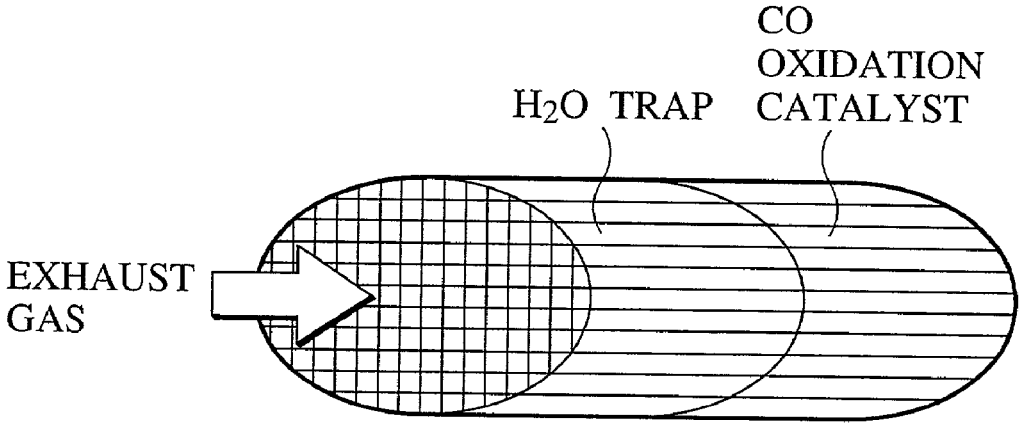
FIG. 5 is a view showing a constituent example 1 of an underfloor catalyst according to the second embodiment.

FIG. 4 shows a block diagram of an engine exhaust system in this embodiment. The same elements as those in FIG. 1 are represented by the same reference numerals.

An exhaust pipe 2 from an engine body 1 is provided with an exhaust emission purification catalyst 3. An underfloor catalyst 10 including a CO oxidation catalyst which has low light-off temperature characteristics and a $H_2O$ trap is disposed downstream of the exhaust emission purification catalyst.

A secondary air introduction pipe 9 extending from an air pump 8 is connected between the exhaust emission purification catalyst 3 and the underfloor catalyst 10. The secondary air introduced here is used to control a reaction in the CO oxidation catalyst 6.

The air/fuel ratio and the amount of the secondary air are controlled based on signals from a temperature sensor 7 attached to the underfloor catalyst 10 according to a flowchart of FIG. 2 described above.

The constituent examples of the underfloor catalyst 10 are shown in FIG. 5, FIG. 6 and FIGS. 7A to 7C.

Figure 6:
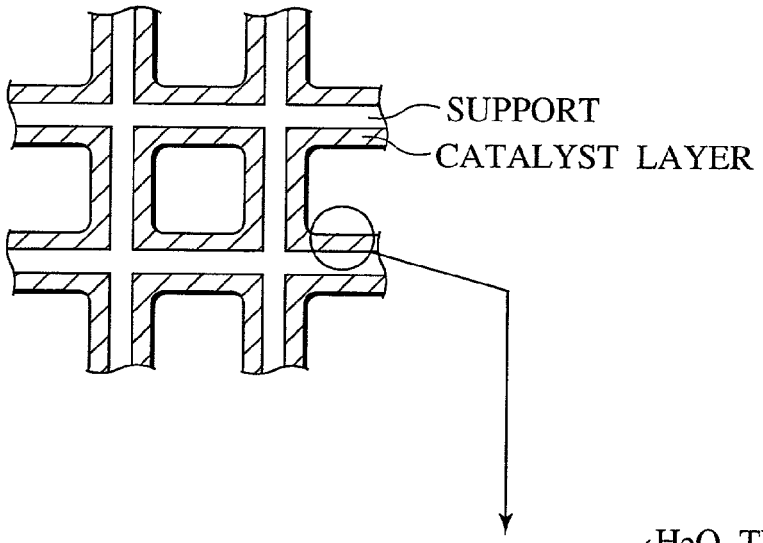
FIG. 6 is a view showing a constituent example 2 of an underfloor catalyst according to the second embodiment.

The constituent example of FIG. 6 is obtained by allowing the CO oxidation catalyst and the $H_2O$ trap to be coated on the same honeycomb support by separately applying the both layer-wise or mixing the both. Because the both are disposed very close to each other, the effect of a rise in temperature due to the adsorption heat of $H_2O$ can be utilized in an efficient manner.

Figure 7A:
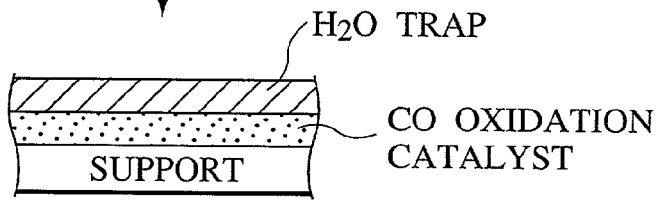
FIG. 7A is a view showing an example A in which a $H_2O$ trap is arranged as the upper layer and a CO oxidation catalyst is arranged as the lower layer in the constituent example 2 of the underfloor catalyst according to the second embodiment.
Figure 7B:
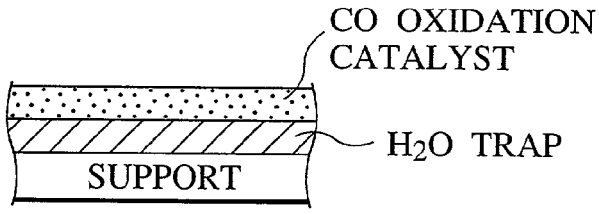
FIG. 7B is a view showing an example B in which a CO oxidation catalyst is arranged as the upper layer and a $H_2O$ trap is arranged as the lower layer in the constituent example 2 of the underfloor catalyst according to the second embodiment.
Figure 7C:
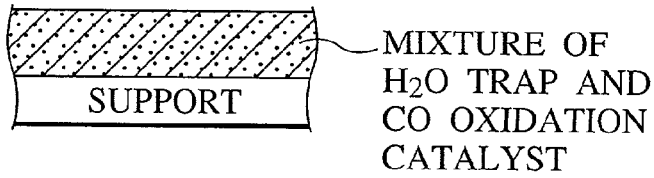
FIG. 7C is a view showing an example C in which a $H_2O$ trap and a CO oxidation catalyst are mixed with each other and supported in the constituent example 2 of the underfloor catalyst according to the second embodiment.

In three types of constitution shown in FIGS. 7A to 7C, there is no large difference in temperature rise properties. However, a structure in which the $H_2O$ trap is arranged as the upper layer as shown in FIG. 7A is desirable to efficiently remove $H_2O$ which is a component disturbing the activity of the catalyst.

It is to be noted that although the HC trap is omitted in this embodiment, it may be disposed downstream of the exhaust emission purification catalyst 3 and the secondary air introduction pipe 9 and upstream of the underfloor catalyst 10 containing the CO oxidation catalyst and the $H_2O$ trap.

The contents of Japanese Patent Application No. 2000-337,073 (filed Nov. 6, 2000) are incorporated herein by reference.

Although the invention has been described above by reference to certain embodiments of the invention, the invention is not limited to the embodiments described above. Modifications and variations of the embodiments described above will occur to those skilled in the art, in light of the above teachings.

What is claimed is:

1. An exhaust emission control device of an internal combustion engine comprising:

a CO oxidation catalyst;

a $H_2O$ trap disposed upstream of and close to the CO oxidation catalyst so dimensioned that adsorption heat and condensation heat of $H_2O$ contribute to a rise in temperature of the CO oxidation catalyst, the $H_2O$ trap being supported separately from the CO oxidation catalyst;

a secondary air supply unit disposed upstream of the $H_2O$ trap; and a HC trap disposed upstream of the secondary air supply unit.

2. An exhaust emission control device of an internal combustion engine according to claim 1, wherein the CO oxidation catalyst has low temperature light-off characteristics.

3. An exhaust emission control device of an internal combustion engine according to claim 1, further comprising a secondary air supply unit disposed upstream of the $H_2O$ trap.

4. An exhaust emission control device of an internal combustion engine according to claim 1, further comprising a HC trap disposed upstream of the $H_2O$ trap.

5. An exhaust emission control device of an internal combustion engine according to claim 1, wherein the $H_2O$ trap is disposed upstream of and close to the CO oxidation catalyst and so dimensioned that adsorption heat and condensation heat of $H_2O$ contribute to a rise in temperature of the CO oxidation catalyst to attain an early activation of the CO oxidation catalyst.

6. An exhaust emission control device of an internal combustion engine, comprising:

a low temperature light-off CO oxidation catalyst;

a $H_2O$ trap disposed upstream of and close to the CO oxidation catalyst so dimensioned that adsorption heat and condensation heat of $H_2O$ contribute to a rise in temperature of the CO oxidation catalyst, the $H_2O$ trap being supported separately from the CO oxidation catalyst;

a secondary air supply unit disposed upstream of the $H_2O$ trap; and a HC trap disposed upstream of the secondary air supply.

7. An exhaust emission control device of an internal combustion engine according to claim 6, wherein the $H_2O$ trap is disposed upstream of and close to the CO oxidation catalyst and so dimensioned that adsorption heat and condensation heat of $H_2O$ contribute to a rise in temperature of the CO oxidation catalyst to attain an early activation of the CO oxidation catalyst.

8. An exhaust emission control device of an internal combustion engine, comprising:

an underfloor catalyst wherein a low temperature light-off CO oxidation catalyst and a $H_2O$ trap are coated on a support, so dimensioned that adsorption heat and condensation heat of $H_2O$ contribute to a rise in temperature of the low temperature light-off CO oxidation catalyst; and a secondary air supply unit disposed upstream of the underfloor catalyst; and a HC trap disposed upstream of the secondary air supply.

9. An exhaust emission control device of an internal combustion engine according to claim 8, wherein the underfloor catalyst is so dimensioned that adsorption heat and condensation heat of $H_2O$ contribute to a rise in temperature of the CO oxidation catalyst to attain an early activation of the CO oxidation catalyst.

10. An exhaust emission control device of an internal combustion engine according to claim 8, wherein the $H_2O$ trap is disposed upstream of the CO oxidation catalyst.

11. An exhaust emission control device of an internal combustion engine according to claim 8, wherein the $H_2O$ trap and the CO oxidation catalyst are mixed with each other.

12. An exhaust emission control device of an internal combustion engine according to claim 8, wherein the $H_2O$ trap and the CO oxidation catalyst are coated on the support while the both are overlapped layer-wise on each other.

13. An exhaust emission control device of an internal combustion engine according to claim 12, wherein the $H_2O$ trap is disposed as the upper layer and the CO oxidation catalyst is disposed as the lower layer.

* * * * *